US008897678B2

(12) United States Patent
Yamanaka

(10) Patent No.: US 8,897,678 B2
(45) Date of Patent: Nov. 25, 2014

(54) TONER REPLENISHING DEVICE HAVING A COIL SPRING AND SPHERICAL MEMBER AT END OF COIL SPRING FOR LOOSENING TONER AND IMAGE FORMING APPARATUS PROVIDED THEREWITH

(75) Inventor: Tatsuya Yamanaka, Osaka (JP)

(73) Assignee: Kyocera Document Solutions Inc., Osaka-shi (JP)

( * ) Notice: Subject to any disclaimer, the term of this patent is extended or adjusted under 35 U.S.C. 154(b) by 308 days.

(21) Appl. No.: 13/545,434

(22) Filed: Jul. 10, 2012

(65) Prior Publication Data

US 2013/0017001 A1 Jan. 17, 2013

(30) Foreign Application Priority Data

Jul. 14, 2011 (JP) ..... 2011-155722

(51) Int. Cl.
*G03G 15/08* (2006.01)

(52) U.S. Cl.
CPC ..... *G03G 15/0879* (2013.01)
USPC ..... 399/258

(58) Field of Classification Search
USPC ..... 399/258, 252, 253, 254, 255, 256, 257, 399/259, 260, 261, 262
See application file for complete search history.

(56) References Cited

U.S. PATENT DOCUMENTS

2009/0103952 A1* 4/2009 Sakamoto et al. ..... 399/258
2010/0172674 A1 7/2010 Suzuki

FOREIGN PATENT DOCUMENTS

| | | |
|---|---|---|
| JP | 59-30576 | 2/1984 |
| JP | 59-30579 | 2/1984 |
| JP | 2000-284594 | 10/2000 |
| JP | 2003-131534 | 5/2003 |
| JP | 2008-216360 | 9/2008 |
| JP | 2009-276631 | 11/2009 |

* cited by examiner

*Primary Examiner* — Billy Lactaoen
(74) *Attorney, Agent, or Firm* — Gerald E. Hespos; Michael J. Porco; Matthew T. Hespos

(57) ABSTRACT

A toner replenishing device includes a toner conveying portion, a conveying member, a toner loosening member and a swinging member. The toner conveying portion has a vertical conveying portion for vertically conveying toner, and a horizontal conveying portion for horizontally conveying the toner. The conveying member is disposed in the horizontal conveying portion, and has a shaft member and a projecting portion formed around the shaft member. The toner loosening member is disposed in the vertical conveying portion to be swingable up and down. The swinging member is contactable with the conveying member and the toner loosening member. The swinging member swings up and down by a change in a contact portion with respect to the conveying member between the shaft member and the projecting portion, as the conveying member rotates. The toner loosening member swings up and down as the swinging member swings.

9 Claims, 7 Drawing Sheets

40
60
50
52T
52S
52(52E)
51(51E)
d1
d2
d3

TONER REPLENISHING DEVICE HAVING A COIL SPRING AND SPHERICAL MEMBER AT END OF COIL SPRING FOR LOOSENING TONER AND IMAGE FORMING APPARATUS PROVIDED THEREWITH

This application is based on Japanese Patent Application No. 2011-155722 filed on Jul. 14, 2011, the contents of which are hereby incorporated by reference.

BACKGROUND

The present disclosure relates to a toner replenishing device for replenishing toner from a first container to a second container, and an image forming apparatus incorporated with the same.

An electrophotography image forming apparatus such as a printer or a copier includes a photosensitive drum for carrying an electrostatic latent image, a developing device for developing the electrostatic latent image into a toner image by supplying toner to the photosensitive drum, and a toner container for replenishing the developing device with toner. In an image forming apparatus for forming a full-color image, there may be employed a layout that an intermediate transfer unit is interposed between a toner container and a developing device. In such an arrangement, since the toner container and the developing device are disposed away from each other, a toner conveying portion for conveying toner from a toner discharge port of the toner container to a toner inlet of the developing device is formed.

In the above arrangement, if the toner discharge port can be formed at a position immediately above the toner inlet, it is possible to construct the toner conveying portion by merely forming a vertical conveying portion along which toner is allowed to drop downwardly. However, it is difficult to form a toner discharge port at a position immediately above a toner inlet due to the layout constraint of various units. In such a case, it is required to construct the toner conveying portion by forming a horizontal conveying portion for horizontally conveying toner, in addition to the vertical conveying portion. A conveying screw for conveying toner in the horizontal conveying portion is disposed in the horizontal conveying portion.

A toner conveying portion configured in such a manner that a horizontal conveying portion is disposed at a position posterior to a vertical conveying portion has a drawback that toner may be coagulated in the vicinity of an end portion of the vertical conveying portion (a start portion of the horizontal conveying portion), and smooth replenishment of toner may be obstructed. This is because the toner in the vicinity of the exit of the vertical conveying portion is likely to be conveyed backwardly by a rotational driving force of the conveying screw, and the toner is coagulated and clogs a convey path. Conventionally, there has been proposed a device constructed in such a manner that a torsion coil spring that is configured to swing as the conveying screw is rotated is mounted on the conveying screw for eliminating the above drawback.

With use of the conventional device, it is possible to prevent coagulation of toner in a region where the torsion coil spring swings. However, if toner is coagulated in a region outside of the region where the torsion coil spring swings, it is impossible or difficult to return the coagulated toner to a loosened state. Since it is difficult to manufacture a torsion coil spring having a sufficiently long length, there has been a demand for a technique of securely loosening the toner in a vertical conveying portion.

In view of the above, an object of the present disclosure is to provide an arrangement capable of securely conveying toner in a toner conveying portion configured in such a manner that a horizontal conveying portion is disposed at a position posterior to a vertical conveying portion, without coagulation.

SUMMARY

A toner replenishing device according to an aspect of the present disclosure includes a first container which stores toner for replenishment and has a discharge port of toner, a second container which has a replenishment port of toner, and stores replenished toner, a toner conveying portion, a conveying member, a toner loosening member and a swinging member.

The toner conveying portion is a toner conveying portion which conveys the toner in a region between the discharge port and the replenishment port. The toner conveying portion has a vertical conveying portion for vertically conveying the toner, and a horizontal conveying portion for receiving the toner from the vertical conveying portion and horizontally conveying the toner. The conveying member is disposed in the horizontal conveying portion. The conveying member has a shaft member extending in an extending direction of the horizontal conveying portion, and a projecting portion formed around the shaft member. The conveying member conveys the toner by being rotated about an axis of the shaft member. The toner loosening member is disposed in the vertical conveying portion to be swingable up and down. The swinging member is disposed at a connecting portion between the vertical conveying portion and the horizontal conveying portion to be contactable with the conveying member and the toner loosening member. The swinging member swings up and down by a movement of the swinging member which is operable to change a contact portion of the swinging member with respect to the conveying member between the shaft member and the projecting portion, as the conveying member is rotated. The toner loosening member swings up and down as the swinging member swings.

An image forming apparatus according to another aspect of the present disclosure includes an image carrier which carries an electrostatic latent image; a toner container which stores toner for replenishment, and has a discharge port of toner; a developing device which has a replenishment port of toner, and supplies toner to the image carrier; and the toner conveying device having the above arrangement.

These and other objects, features and advantages of the present disclosure will become more apparent upon reading the following detailed description along with the accompanying drawings.

DETAILED DESCRIPTION

Figure 1:
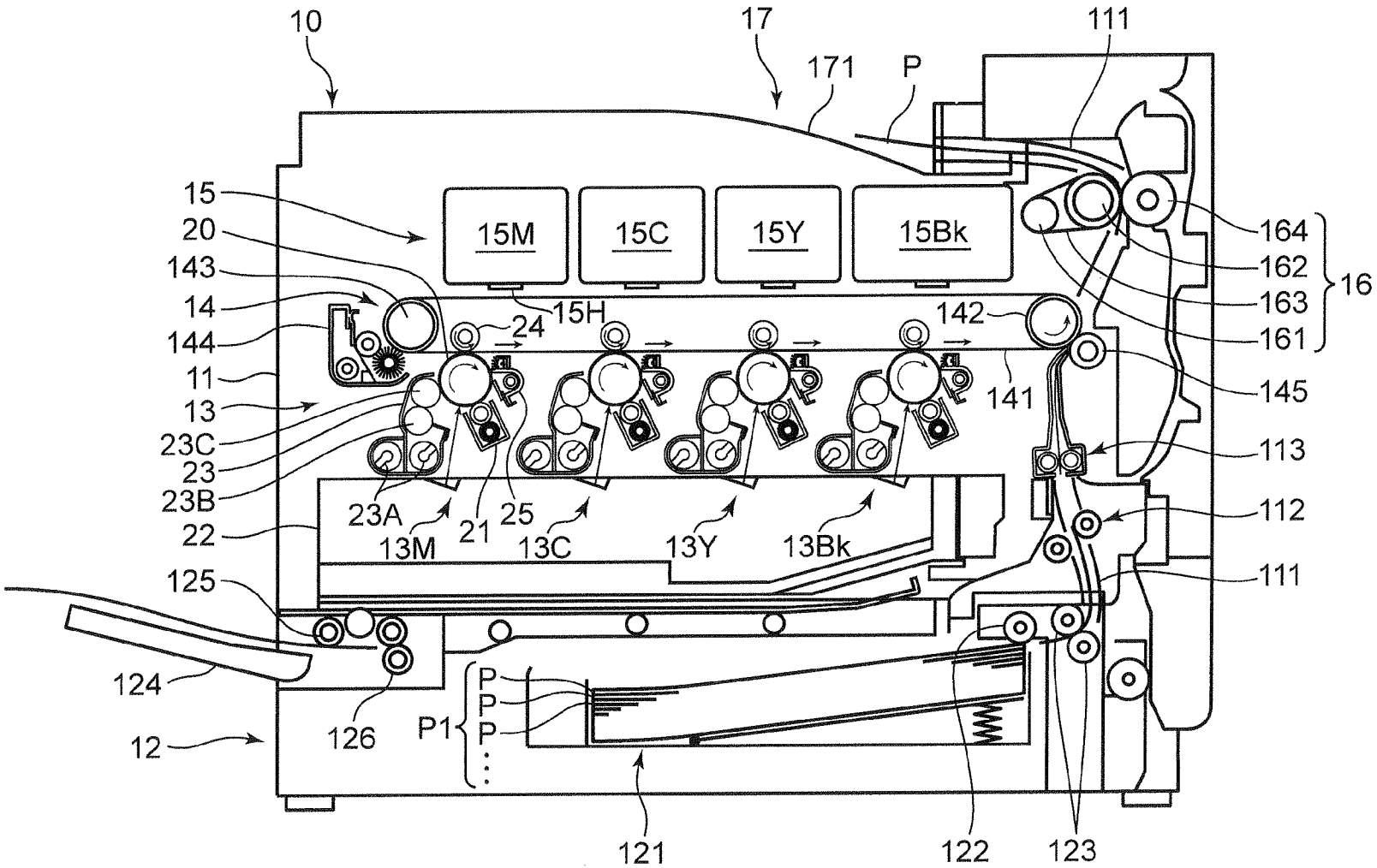
FIG. 1 is a cross-sectional view showing an internal structure of an image forming apparatus embodying the present disclosure.

In the following, an image forming apparatus 10 embodying the present disclosure is described referring to the drawings in detail. In the embodiment, there is described a tandem-type color printer, as an example of the image forming apparatus. The image forming apparatus may be e.g. a copier, a facsimile machine, or a complex machine having the functions of these devices.

FIG. 1 is a cross-sectional view showing an internal structure of the image forming apparatus 10. The image forming apparatus 10 is provided with an apparatus body 11 having a box-shaped housing structure. The apparatus body 11 is internally provided with a sheet feeding portion 12 for feeding a sheet P, an image forming assembly 13 for forming a toner image to be transferred onto the sheet P fed from the sheet feeding portion 12, an intermediate transfer unit 14 for transferring the toner image by primary transfer, a toner replenishing portion 15 for replenishing toner to the image forming assembly 13, and a fixing portion 16 for applying a processing of fixing an unfixed toner image formed on the sheet P onto the sheet P. The apparatus body is further provided with a sheet discharging portion 17 for discharging the sheet P subjected to a fixing processing in the fixing portion 16, at an upper position of the apparatus body 11.

The apparatus body 11 is provided with an unillustrated operation panel for allowing a user to input e.g. an output condition for a sheet P, at an appropriate position on a top surface of the apparatus body 11. The operation panel includes a power source key, a touch panel for allowing the user to input the output condition, and various operation keys.

The apparatus body 11 is internally formed with a vertically extending sheet transport path 111 on the right side of the image forming assembly 13. A pair of transport rollers 112 for transporting a sheet is disposed at an appropriate position in the sheet transport path 111. Further, a pair of registration rollers 113 for performing skew correction of a sheet, and feeding the sheet to a secondary transfer nip portion to be described later at a predetermined timing is disposed on the upstream side of the secondary transfer nip portion in the sheet transport path 111. The sheet transport path 111 is a transport path along which a sheet P is transported from the sheet feeding portion 12 to the sheet discharging portion 17 via the image forming assembly 13 and the fixing portion 16.

The sheet feeding portion 12 is provided with a sheet feeding tray 121, a pickup roller 122, and a pair of sheet feeding rollers 123. The sheet feeding tray 121 is detachably mounted at a lower position of the apparatus body 11, and stores a sheet stack P1 constituted of a stack of sheets P. The pickup roller 122 is adapted to dispense the sheet stack P1 stored in the sheet feeding tray 12 one by one from the uppermost sheet P of the sheet stack P1. The sheet feeding roller pair 123 is adapted to feed the sheet P dispensed by the pickup roller 122 to the sheet transport path 111.

The sheet feeding portion 12 is provided with a manual sheet feeding portion to be mounted on a left side wall of the apparatus body 11 in FIG. 1. The manual sheet feeding portion is provided with a manual tray 124, a pickup roller 125, and a pair of sheet feeding rollers 126. The manual tray 124 is a tray on which a sheet P to be manually fed is placed. As shown in FIG. 1, the manual tray 124 is opened in a side wall of the apparatus body 11 when the user manually feeds a sheet P. The pickup roller 125 is adapted to dispense the sheet P placed on the manual tray 124. The sheet feeding roller pair 126 feeds the sheet P dispensed by the pickup roller 125 to the sheet transport path 111.

The image forming assembly 13 is adapted to form a toner image to be transferred onto a sheet P. The image forming assembly 13 is provided with a plurality of image forming units for forming toner images of different colors. In this embodiment, the image forming units are a magenta unit 13M using a developer of magenta (M), a cyan unit 13C using a developer of cyan (C), a yellow unit 13Y using a developer of yellow (Y), and a black unit 13Bk using a developer of black (Bk), which are arranged in this order from upstream side toward downstream side in a rotating direction of an intermediate transfer belt 141 to be described later (from right side to left side in FIG. 1). Each of the units 13M, 13C, 13Y, 13Bk is provided with a photosensitive drum 20 (image carrier); and a charger 21, a developing device 23, a primary transfer roller 24 and a cleaning device 25 disposed around the photosensitive drum 20. Further, an exposure device 22 commonly used between the units 13M, 13C, 13Y, 13Bk is disposed below the image forming units.

The photosensitive drum 20 is rotated and driven about an axis thereof for forming an electrostatic latent image and a toner image on a circumferential surface of the photosensitive drum 20. A photosensitive drum using an amorphous-silicon (a-Si)-based material is used as the photosensitive drum 20. The charger 21 uniformly charges the circumferential surface of the photosensitive drum 20. The charger 21 may be a contact-type charging device provided with a charging roller, and a charging cleaning brush for removing toner adhered to the charging roller. The exposure device 22 has various optical devices such as a light source, a polygon mirror, a reflection mirror and a deflection mirror. The exposure device 22 irradiates the circumferential surface of the photosensitive drum 20 that has been uniformly charged by the charger 21, with laser light modulated based on image data, for forming an electrostatic latent image.

The developing device 23 (second container) supplies toner to the circumferential surface of the photosensitive drum 20 for developing an electrostatic latent image formed on the photosensitive drum 20. The developing device 23 is designed to use a two-component developer composed of toner and carrier. The developing device 23 includes two agitation rollers 23A, a magnetic roller 23B, and a developing roller 23C. The agitation rollers 23A charge toner while agitating the two-component developer by circulating and transporting the two-component developer. A two-component developer layer is carried on the circumferential surface of the magnetic roller 23B, and a toner layer formed by conveying toner by a potential difference between the magnetic roller 23B and the developing roller 23C is carried on the circumferential surface of the developing roller 23C. The toner on the developing roller 23C is supplied to the circumferential surface of the photosensitive drum 20 for developing the electrostatic latent image.

The primary transfer roller 24 forms a nip portion with the photosensitive drum 20, with the intermediate transfer belt 141 provided in the intermediate transfer unit 14 being interposed between the primary transfer roller 24 and the photosensitive drum 20, for transferring a toner image formed on the photosensitive drum 20 onto the intermediate transfer belt 141 by primary transfer. The cleaning device 25 cleans the circumferential surface of the photosensitive drum 20 after the toner image transfer.

The intermediate transfer unit 14 is disposed in a space defined between the image forming assembly 13 and the toner replenishing portion 15. The intermediate transfer unit 14 is provided with the intermediate transfer belt 141, a driving roller 142 and a driven roller 143 rotatably supported on an unillustrated unit frame. The intermediate transfer belt 141 is an endless belt-like rotating member, and is stretched between the driving roller 142 and the driven roller 143 in such a manner that the circumferential surface of the intermediate transfer belt 141 is contacted with the circumferential surfaces of the respective photosensitive drums 20. A rotational driving force is given to the driving roller 142, and the intermediate transfer belt 141 is circulated and driven as the driving roller 142 rotates. A belt cleaning device 144 for removing toner residues on the circumferential surface of the intermediate transfer belt 141 is disposed near the driven roller 143.

A secondary transfer roller 145 is disposed at such a position as to face the driving roller 142. The secondary transfer roller 145 forms the secondary transfer nip portion by being pressingly contacted with the circumferential surface of the intermediate transfer belt 141. A toner image transferred to the intermediate transfer belt 141 by primary transfer is transferred onto a sheet P fed from the sheet feeding portion 12 in the secondary transfer nip portion by secondary transfer.

The toner replenishing portion 15 is adapted to store toner for use in image formation. In the embodiment, the toner replenishing portion 15 is provided with a magenta toner container 15M, a cyan toner container 15C, a yellow toner container 15Y and a black toner container 15Bk, all of which serve as a first container. The toner containers 15M, 15C, 15Y, 15Bk respectively store toner of respective colors of magenta (M), cyan (C), yellow (Y) and black (Bk) for replenishment. The toner containers 15M, 15C, 15Y, 15Bk replenish the toner of the respective colors to the developing devices 23 in the image forming units 13M, 13C, 13Y, 13Bk corresponding to the respective colors of MCYBk, from toner discharge ports 15H formed in bottom surfaces of the respective toner containers 15M, 15C, 15Y, 15Bk by way of toner conveying portions 30 to be described later in detail.

The fixing portion 16 is provided with a heating roller 161 internally provided with a heat source, a fixing roller 162 disposed at such a position as to face the heating roller 161, a fixing belt 163 stretched between the fixing roller 162 and the heating roller 161, and a pressing roller 164 which is disposed at such a position as to face the fixing roller 162 via the fixing belt 163, and forms a fixing nip portion. A sheet P fed to the fixing portion 16 is heated and pressed while passing through the fixing nip portion. Thereby, a toner image transferred to the sheet P at the secondary transfer nip portion is fixed onto the sheet P.

The sheet discharging portion 17 is formed into a recess portion by hollowing a top portion of the apparatus body 11, thereby forming a sheet discharging tray 171 for receiving a sheet P discharged onto a bottom portion of the recess portion. The sheet P subjected to a fixing processing is discharged toward the sheet discharging tray 171 via the sheet transport path 111 extending from an upper portion of the fixing portion 16.

Figure 2:
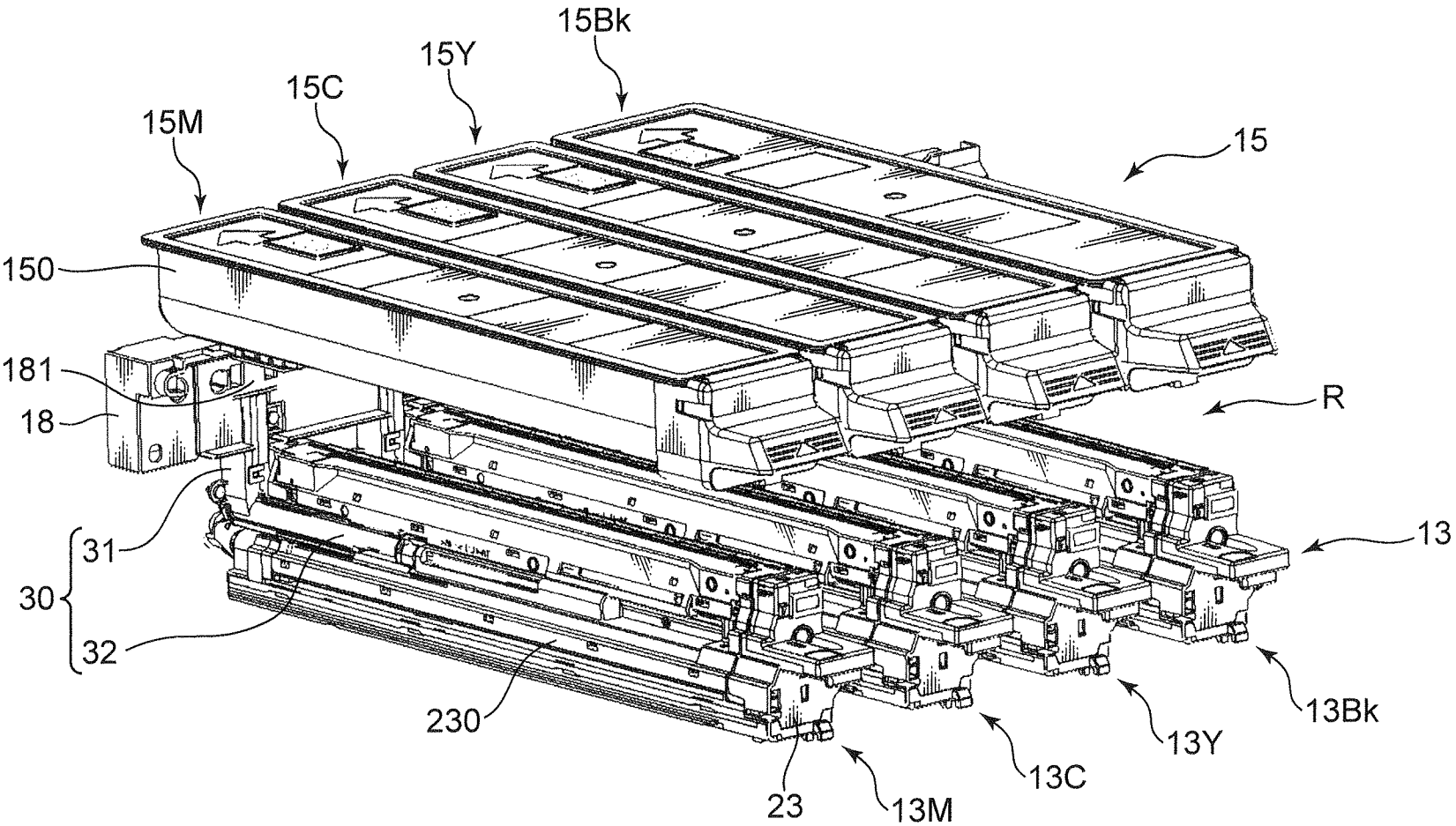
FIG. 2 is a perspective view showing a toner replenishing device.
Figure 3:
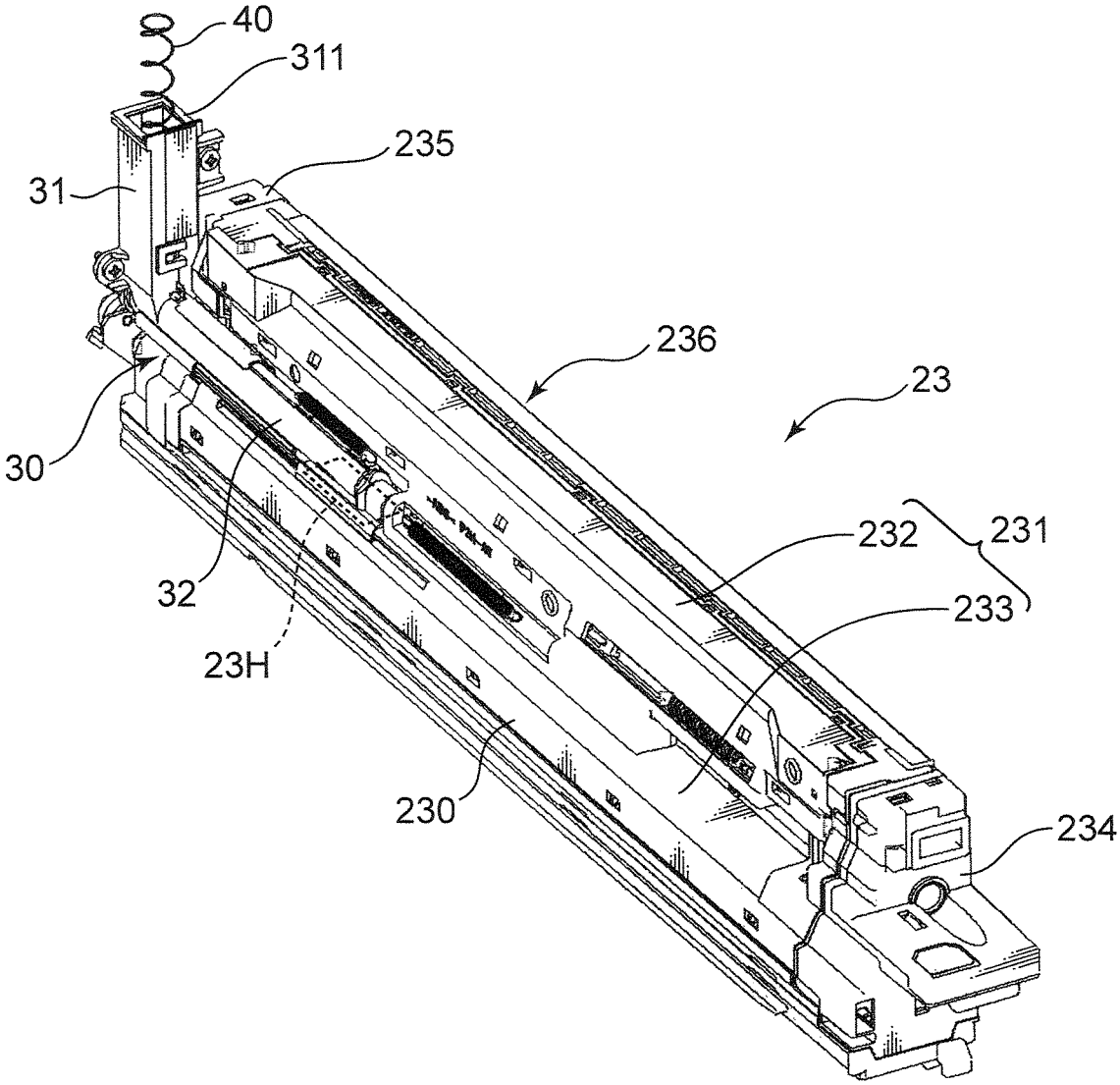
FIG. 3 is a perspective view showing one developing device and one toner conveying portion.

FIG. 2 is a perspective view showing a state that the image forming assembly 13 (developing devices 23) and the toner replenishing portion 15 (embodiment of the toner replenishing device according to the present disclosure) are detached from the apparatus body 11. FIG. 3 is a perspective view enlargedly showing one developing device 23. As described above, the image forming assembly 13 is constituted of the four image forming units 13M, 13C, 13Y, 13Bk. The image forming units 13M, 13C, 13Y, 13Bk are horizontally arranged side by side in parallel to each other. In FIG. 2, only the developing devices 23 in the image forming units 13M, 13C, 13Y, 13Bk are shown. Further, the toner replenishing portion 15 is constituted of the four toner containers 15M, 15C, 15Y, 15Bk. The toner containers 15M, 15C, 15Y, 15Bk are horizontally arranged side by side in parallel to each other. The intermediate transfer unit 14 is accommodated in a space R between the image forming assembly 13 and the toner replenishing portion 15. FIG. 2 shows a base member 18 provided with a rail having a guide function for use in attaching and detaching the intermediate transfer unit 14 to and from the apparatus body 11. The illustration of the intermediate transfer unit 14 itself is omitted in FIG. 2.

The replenishment toner stored in container housings 150 of the respective toner containers 15M, 15C, 15Y, 15Bk is conveyed into developing housings 230 of the respective image forming units 13M, 13C, 13Y, 13Bk through the toner conveying portions 30. The respective toner containers 15M, 15C, 15Y, 15Bk are disposed at positions near immediately above the respective corresponding image forming units 13M, 13C, 13Y, 13Bk. However, the toner discharge port 15H of each of the container housings 150 is not formed at a position immediately above a toner replenishment port 23H (see FIG. 3) of the corresponding developing housing 230 for receiving the replenishment toner. In view of the above, each of the toner conveying portions 30 is formed with a vertical conveying portion 31 for vertically conveying (dropping) toner, and a horizontal conveying portion 32 for receiving the toner from the vertical conveying portion 31 and horizontally conveying the toner.

As shown in FIG. 3, the developing housing 230 of the developing device 23 is a housing having a long size in the axial direction of the photosensitive drum 20. The developing housing 230 houses therein a two-component developer composed of toner and carrier, and houses therein the agitation rollers 23A, the magnetic roller 23B and the developing roller 23C shown in FIG. 1. A top plate 231 of the developing housing 230 includes a first top plate 232 which covers above the developing roller 23C, and a second top plate 233 which is disposed at a position lower than the first top plate 232, and covers above the agitation rollers 23A.

A first side plate 234 and a second side plate 235 for rotatably supporting the agitation rollers 23A, the magnetic roller 23B and the developing roller 23C are disposed on both sides of the developing housing 230. An opening 236 is formed in the developing housing 230 at a position beneath the first top plate 232 and at such a position as to face the photosensitive drum 20, for exposing a part of the circumferential surface of the developing roller 23C. The toner conveying portion 30 is attached to the developing device 23 in such a manner that the vertical conveying portion 31 is adjacent to the second side plate 235 and the horizontal conveying portion 32 is disposed above the second top plate 233. In this embodiment, the toner discharge port 15H and an upper end opening 311 of the vertical conveying portion 31 are not directly communicated with each other, and a communication convey path 181 formed in the base member 18 is interposed between the toner discharge port 15H and the upper end opening 311 of the vertical conveying portion 31.

Figure 4:
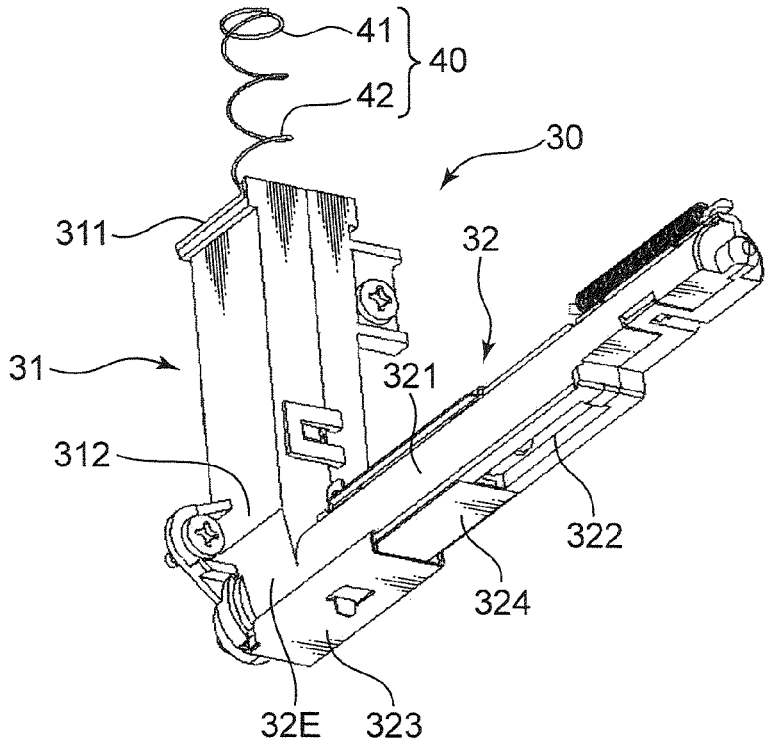
FIG. 4 is a perspective view of the toner conveying portion.
Figure 5:
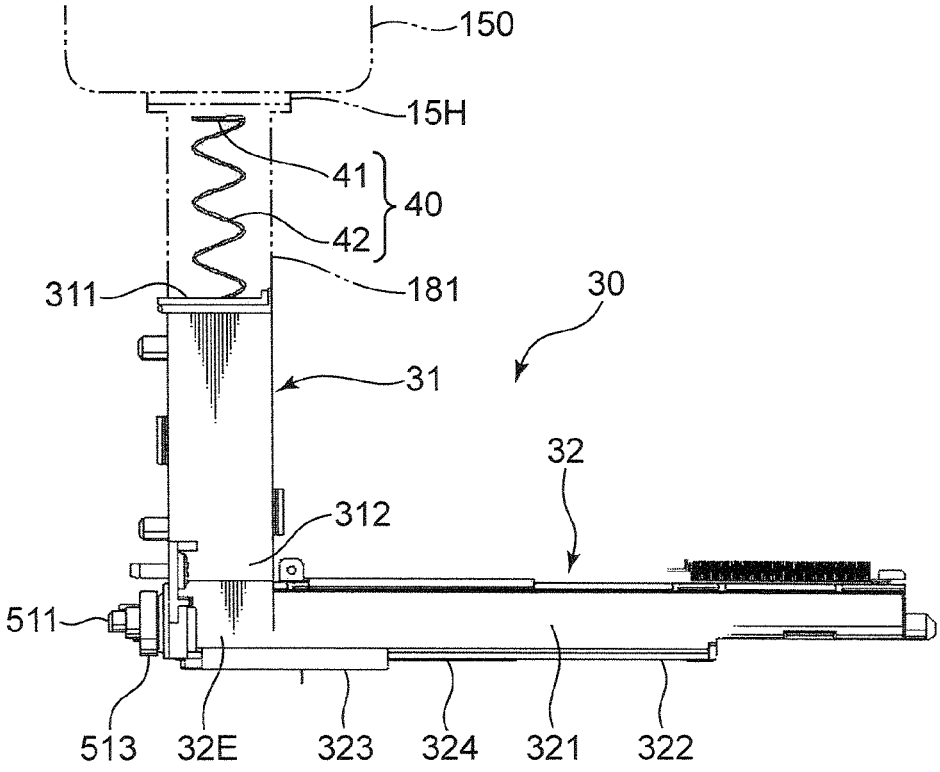
FIG. 5 is a side view of the toner conveying portion.
Figure 6:
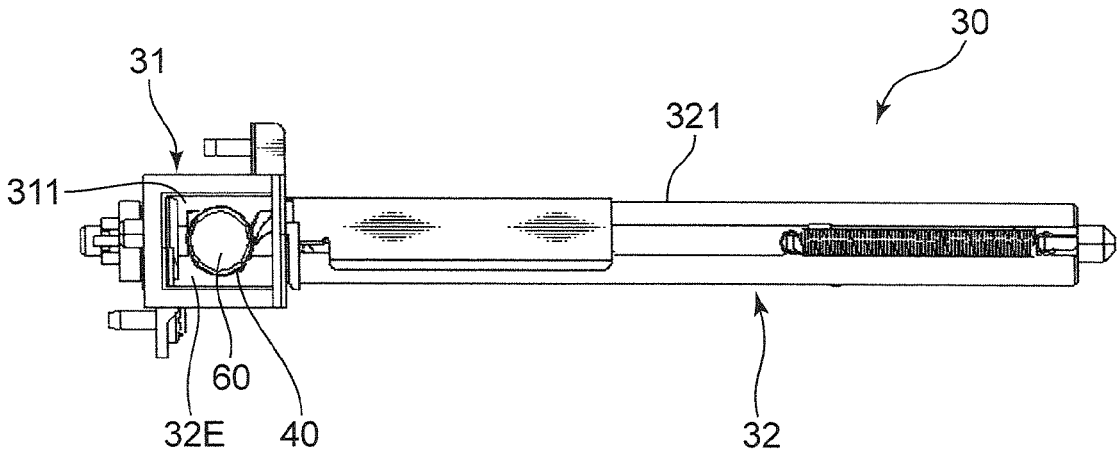
FIG. 6 is a top plan view of the toner conveying portion.
Figure 7:
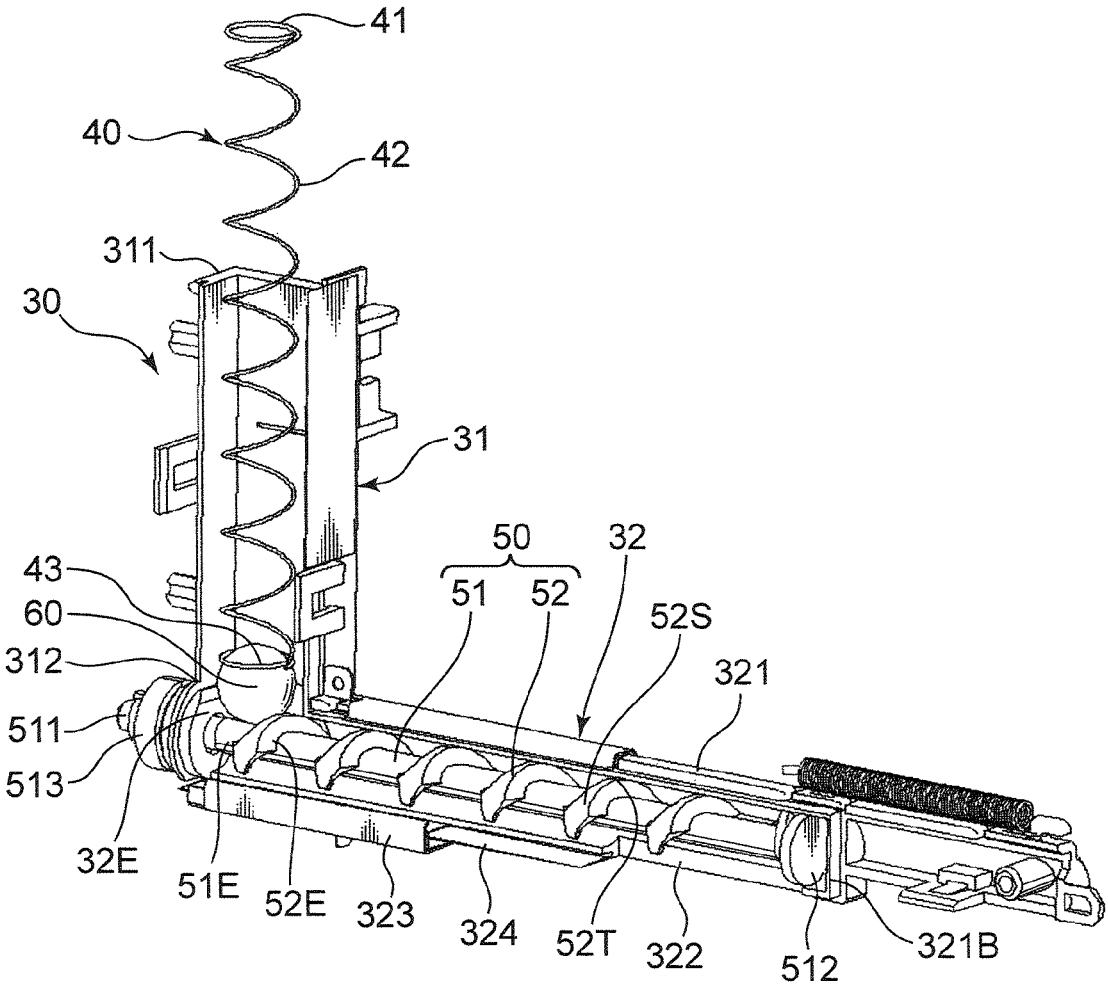
FIG. 7 is an inner perspective view of the toner conveying portion.
Figure 8:
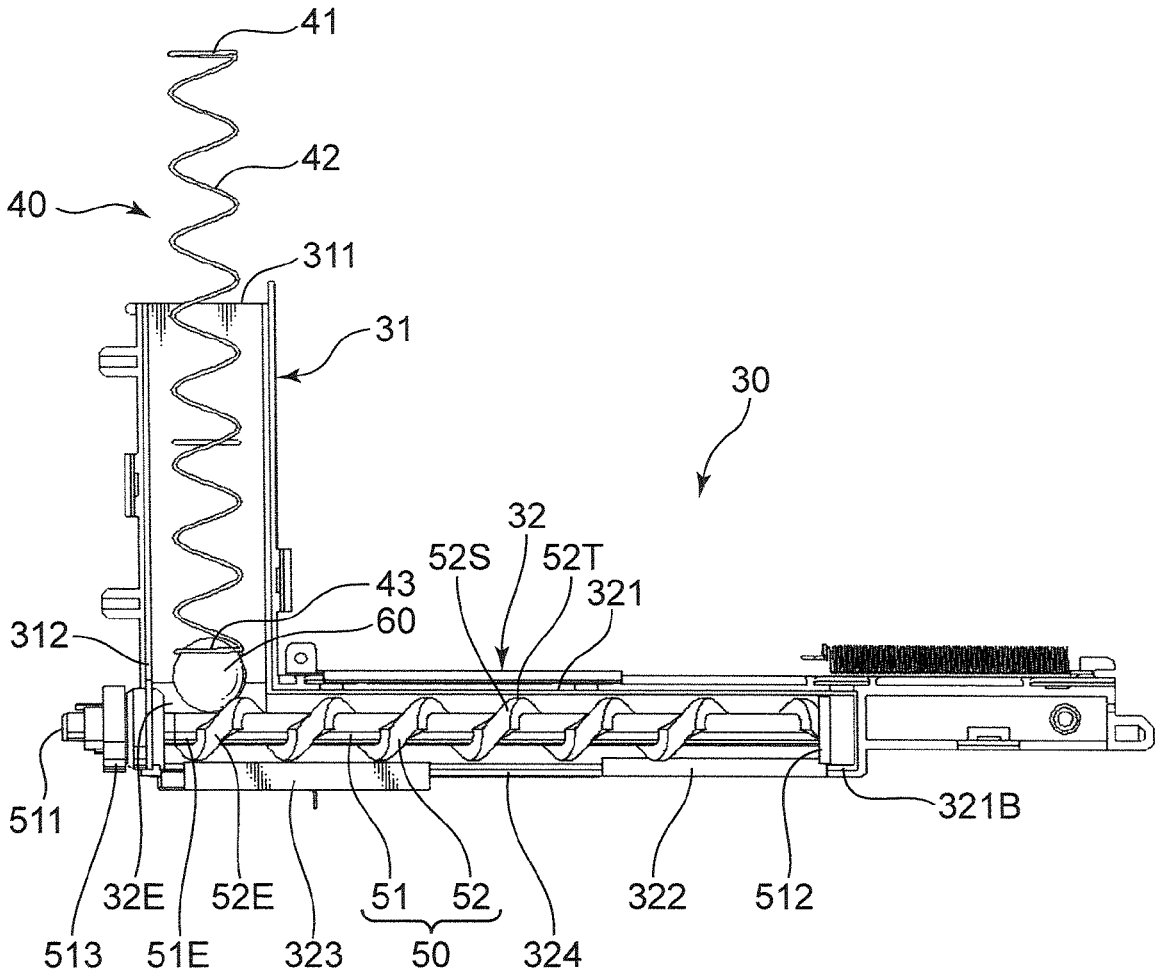
FIG. 8 is an inner side view of the toner conveying portion.

Next, the toner conveying portion 30 and an internal structure thereof are described in detail referring to FIGS. 4 through 8. FIG. 4 is a perspective view of the toner conveying portion 30, FIG. 5 is a side view of the toner conveying portion 30, FIG. 6 is a top plan view of the toner conveying portion 30, FIG. 7 is an inner perspective view of the toner conveying portion 30, and FIG. 8 is an inner side view of the toner conveying portion 30. The toner conveying portion 30 is composed of a tubular member having a substantially L-shape in side view, which is constructed by integrally connecting the vertical conveying portion 31 constituted of a vertically extending vertical tubular portion of a rectangular shape in section, and the horizontal conveying portion 32 constituted of a horizontally extending horizontal tubular portion of a circular shape in section. The vertical conveying portion 31 is internally provided with a toner loosening member 40 constituted of a member having a coil spring shape. Further, a conveying screw 50 for conveying toner is provided in the horizontal conveying portion 32. Furthermore, a swinging ball 60 (spherical member/swinging member) contactable with both of the toner loosening member 40 and a conveying screw 50 is provided at a position near a connecting portion between the vertical conveying portion 31 and the horizontal conveying portion 32.

As shown in FIG. 5, the upper end opening 311 of the vertical conveying portion 31 is communicated with the toner discharge port 15H of the container housing 150 via the communication convey path 181 in the base member 18. The communication convey path 181 is constituted of a vertically extending vertical tubular portion of a rectangular shape in section, as well as the vertical conveying portion 31. On the other hand, a lower end 312 of the vertical conveying portion 31 is communicated with a region above an upstream end 32E of the horizontal conveying portion 32. With this arrangement, when the toner is discharged through the toner discharge port 15H, the toner is allowed to drop down through the communication convey path 181 and the vertical conveying portion 31, and reaches the upstream end 32E of the horizontal conveying portion 32.

The horizontal conveying portion 32 is provided with a tubular body 321, a toner ejection port 322, a shutter member 323 and a guide portion 324. The tubular body 321 horizontally extends, and is internally formed with a tubular hollow space having a circular shape in section. An end of the tubular body 321 is communicated with the lower end 312 of the vertical conveying portion 31. The toner ejection port 322 is a rectangular ejection port extending in the extending direction of the tubular body 321, and is a hole formed in a lower surface of the other end of the tubular body 321. The toner received through the upper end opening 311 of the vertical conveying portion 31 is conveyed through the vertical conveying portion 31 and the horizontal conveying portion 32, and is ejected through the toner ejection port 322. The position of the toner ejection port 322 is aligned with the position of the toner replenishment port 23H (see FIG. 3) of the developing housing 230.

The shutter member 323 is a member which is operable to open or close the toner ejection port 322. The shutter member 323 is slidably mounted on the lower surface of the tubular body 321. In FIGS. 4 through 8, the shutter member 323 is set to such a position that the toner ejection port 322 is opened (a state that the shutter member 323 is slid to the side of the upstream end 32E). The guide member 324 is a member for holding the shutter member 323, and is a member having a guide function of slidably moving the shutter member 323 in the extending direction of the tubular body 321.

The toner loosening member 40 is a member which is disposed in the vertical conveying portion 31 and the communication convey path 181 to be swingable up and down, and has a coil spring shape. The toner loosening member 40 is constituted of a member formed by bending a metal wire into a coil shape. The toner loosening member 40 has an upper end ring portion 41, a coil portion 42 continuing from a lower side of the upper end ring portion 41, and a lower end ring portion 43 (circular ring portion) continuing from a lower end of the coil portion 42. The vertical length of the toner loosening member 40 is set slightly shorter than the sum of the length of the vertical conveying portion 31 and the length of the communication convey path 181. The toner leveling member 40 extends substantially over the entire length of a vertical tubular portion constituted of the vertical conveying portion 31 and the communication convey path 181.

The coil outer diameter of the coil portion 42 is set smaller than the interval of a pair of inner walls of the vertical conveying portion 31 and the communication convey path 181 facing each other. With this arrangement, the inner walls of the vertical conveying portion 31 and the communication convey path 181 do not contact with the coil portion 42 in a state that the toner loosening member 40 stands upright. The lower end ring portion 43 is a portion formed by processing a metal wire into a circular shape. The inner diameter of the lower end ring portion 43 is set smaller than the diameter of the swinging ball 60. The lower end ring portion 43 is received in an upper part of the swinging ball 60. The lower end ring portion 43 is configured to be slidable with respect to the swinging ball 60, and is configured in such a manner that a strong force is not exerted on the toner loosening member 40 to such an extent as to tilt down the toner loosening member 40, even if the swinging ball 60 rolls. The inner diameter of the upper end ring portion 41 is set substantially equal to that of the lower end ring portion 43. With this arrangement, it is not necessary to check whether the toner loosening member 40 is mounted upside down in mounting the toner loosening member 40 in the toner conveying portion 30.

The toner loosening member 40 extends in the vertical conveying portion 31 and the communication convey path 181 without being constrained by the other members. The lower end ring portion 43 is received in the upper part of the swinging ball 60 by the weight of the toner loosening member 40. As will be described later, the swinging ball 60 swings up and down, and the coil portion 42 and the upper end ring portion 41 also swing up and down, as the swinging ball 60 swings. With this arrangement, even if the toner in the vertical conveying portion 31 and the communication convey path 181 tends to be coagulated, it is possible to loosen the toner by the up and down swinging movement of the coil portion 42. Thus, the above arrangement prevents the toner from coagulating and clogging the toner convey path. Further, the upper end ring portion 41 hits the vicinity of the toner discharge port 15H by the up and down swinging movement of the upper end ring portion 41. This also prevents the toner from coagulating in the vicinity of the toner discharge port 15H. Thus, with use of the toner loosening member 40 having a coil spring shape, it is possible to efficiently loosen the toner in the vertical conveying portion 31 by the up and down swinging movement of the toner loosening member 40, with a simplified shape of the toner loosening member 40.

The conveying screw 50 is disposed in the tubular body 321 of the horizontal conveying portion 32. The conveying screw 50 receives the toner from the vertical conveying portion 31 at the upstream end 32E, and conveys the received toner toward the toner ejection port 322 formed on the downstream side. The conveying screw 50 is provided with a screw shaft 51 (shaft member) extending in the extending direction of the horizontal conveying portion 32, and a blade portion 52 (projecting portion) formed spirally around the screw shaft 51. The conveying screw 50 conveys the toner by being rotated about the axis of the screw shaft 51.

A first end 511 of the screw shaft 51 projects from the upstream end 32E of the horizontal conveying portion 32 to the outside. A second end 512 of the screw shaft 51, which is formed at a position opposite to the first end 511, extends beyond the toner ejection port 322 and reaches a position near a downstream end 321B of the tubular body 321. The first end 511 is rotatably supported at an end edge of the upstream end 32E. The second end 512 is attached with a disc plate having an outer diameter slightly smaller than the inner diameter of the tubular body 321. An input gear 513 is concentrically mounted at a position near the first end 511. The input gear 513 is engaged with an unillustrated driving gear for giving a rotational driving force to the driving gear. The screw shaft 51 is rotated about the axis thereof by the rotational driving force.

The blade portion 52 applies a thrust force to the toner, as the screw shaft 51 is rotated. The maximum outer diameter of the blade portion 52 is set slightly smaller than the inner diameter of the tubular body 321. The spiral pitch of the blade portion 52 is set larger than the diameter of the swinging ball 60. This is for the following reason. The swinging ball 60 is contacted with the conveying screw 50 at the upstream end 32E. When the conveying screw 50 is rotated, it is preferable to contact the swinging ball 60 with the screw shaft 51, as well as with the blade portion 52. With this arrangement, it is possible to securely swing the swinging ball 60 up and down by the height by which the blade portion 52 projects from the screw shaft 51.

The swinging ball 60 is disposed at the connecting portion between the vertical conveying portion 31 and the horizontal conveying portion 32 in such a manner that the swinging ball 60 is placed on the conveying screw 50. The diameter of the swinging ball 60 is set smaller than the interval between a pair of inner walls (wall surfaces for dividing the vertical conveying portion) of the vertical conveying portion 31 facing each other and having a substantially square shape in section, and is set larger than the inner diameter of the lower end ring portion 43 of the toner loosening member 40, as described above. The swinging ball 60 is placed near the upstream end 32E (lower end 312 of the vertical conveying portion 31) of the horizontal conveying portion 32 in a state that the swinging ball 60 is not constrained by the other members, and is contacted with the conveying screw 50 by the weight of the swinging ball 60.

With this arrangement, the swinging ball 60 swings up and down near the lower end 312 of the vertical conveying portion 31 in accordance with a movement of the swinging ball 60 which is operable to change a contact position of the swinging ball 60 with respect to the conveying screw 50 between a circumferential surface of the upstream end 51E of the screw shaft 51 and the upstream end 52E of the blade portion 52, as the conveying screw 50 is rotated. In performing the above operation, however, a horizontal movement of the swinging ball 60 is restricted by the interference between the swinging ball 60, and an inner wall surface of the vertical conveying portion 31 near the lower end 312. As described above, since the lower end ring portion 43 of the toner loosening member 40 is received in the upper part of the swinging ball 60, the toner loosening member 40 also swings, as the swinging ball 60 swings up and down.

Figures 9A, 9B, 9C:
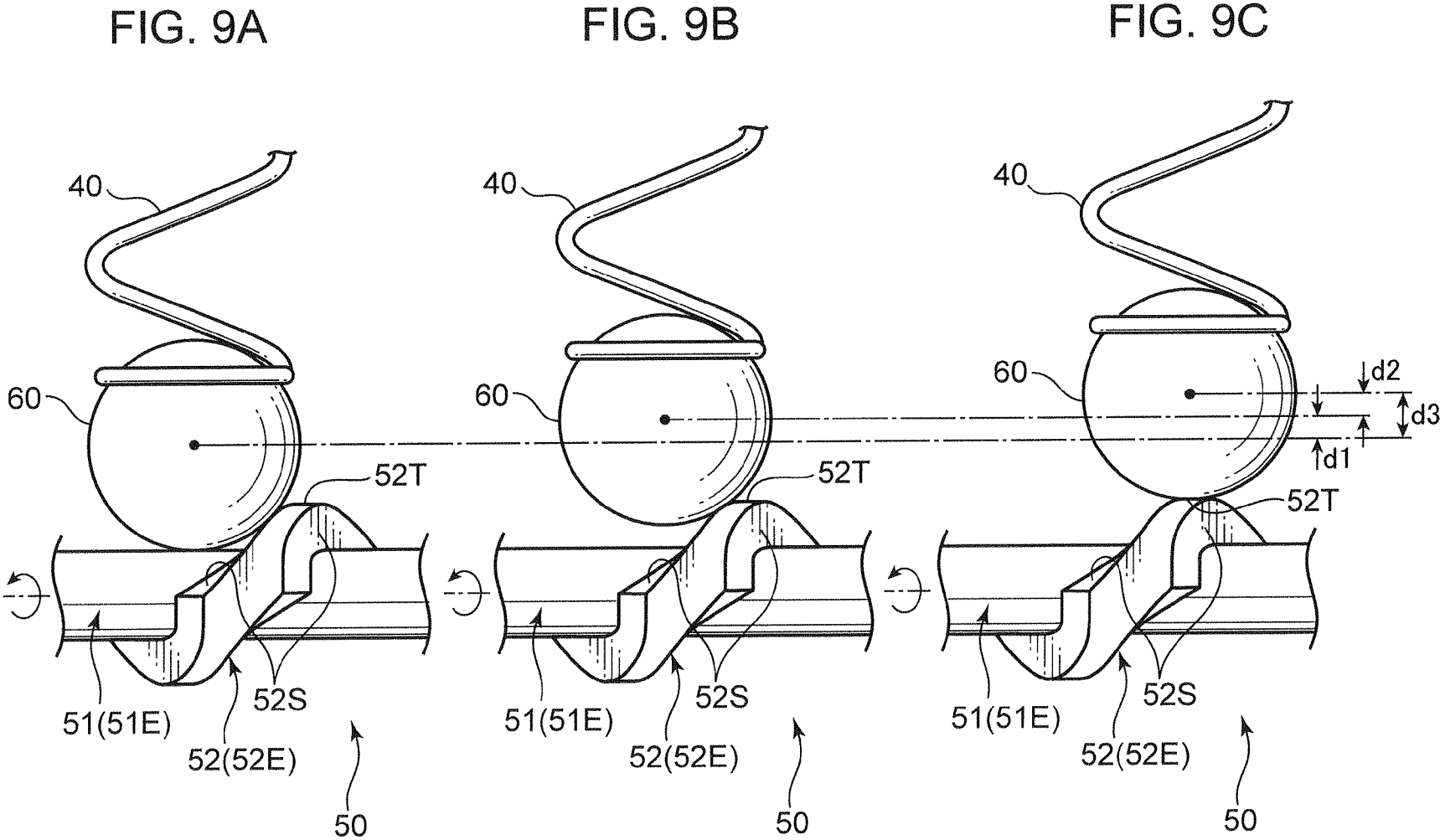
FIGS. 9A though 9C are schematic diagrams for describing an operation of the toner conveying portion.

FIGS. 9A through 9C are schematic diagrams for describing swinging movements of the swinging ball 60 and the toner loosening member 40. FIG. 9A shows a state that the lower part of the swinging ball 60 is contacted with the circumferential surface of the screw shaft 51 of the conveying screw 50. When the swinging ball 60 is brought to the above state, the moving stroke of the swinging ball 60 in a vertical direction is located at a lowermost position.

FIG. 9B shows a state that the conveying screw 50 is rotated about the axis thereof by about 90 degrees from the state shown in FIG. 9A. The blade portion 52 is formed with a top portion 52T serving as a portion having a maximum outer diameter when viewed from the axis direction of the screw shaft 51, and a tilt portion 52S extending from the top portion 52T to the circumferential surface of the screw shaft 51 (see FIG. 7 and FIG. 8). As the conveying screw 50 is rotated, the contact position of the swinging ball 60 with respect to the conveying screw 50 is changed. Specifically, as shown in FIG. 9B, the lower part of swinging ball 60 is contacted with the tilt portion 52S of the blade portion 52. Thereby, the swinging ball 60 is lifted up from the state shown in FIG. 9A by the distance d1.

FIG. 9C shows a state that the conveying screw 50 is further rotated from the state shown in FIG. 9B by about 90 degrees. As the conveying screw 50 is further rotated, the contact position of the swinging ball 60 with respect to the conveying screw 50 is changed from the tilt portion 52S to the top portion 52T. Thereby, the swinging ball 60 is further lifted up from the state shown in FIG. 9B by the distance d2. When the swinging ball 60 is brought in the state shown in FIG. 9C, the moving stroke of the swinging ball 60 in a vertical direction is located at an uppermost position. The swinging ball 60 is brought to such a state that the swinging ball 60 is lifted up from the state shown in FIG. 9A by the distance d3=d1+d2. The distance d3 corresponds to the height by which the blade portion 52 projects from the circumferential surface of the screw shaft 51.

When the conveying screw 50 is rotated from the state shown in FIG. 9C by about 90 degrees, the conveying screw 50 is returned to the state shown in FIG. 9B. Then, when the conveying screw 50 is further rotated from the state shown in FIG. 9B by about 90 degrees, the conveying screw 50 is returned to the state shown in FIG. 9A. In other words, as the conveying screw 50 makes one turn, the swinging ball 60 swings up and down one time in the range of the moving stroke d3 corresponding to the height of the blade portion 52. The toner loosening member 40 also swings up and down, as the swinging ball 60 swings up and down. With this arrangement, the toner in the inside of the vertical conveying portion 31 is constantly stirred by the swinging movement of the toner loosening member 40. This prevents coagulation of toner in the vertical conveying portion 31.

As described above, the toner conveying portion 30 of the embodiment is provided with the swinging ball 60 (swinging member) which swings up and down as the conveying screw 50 (conveying member) is rotated, and the toner loosening member 40 which is allowed to swing up and down by the swinging movement of the swinging ball 60. In other words, the toner loosening member 40 is allowed to swing up and down in the vertical conveying portion 31 in association with the movement of the swinging ball 60, in place of merely agitating the toner by the swinging ball 60. This is advantageously in setting the length of the toner loosening member 40 to an intended length, and extending the toner loosening member 40 over the entire length of the vertical conveying portion 31. Accordingly, it is possible to securely prevent coagulation of toner in the vertical conveying portion 31.

In this embodiment, the conveying member is the conveying screw 50 provided with the screw shaft 51 (shaft member), and the blade portion 52 (projecting portion) formed spirally around the screw shaft 51. When observing the conveying screw 50 in a radial direction with respect to a section orthogonal to the axis direction of the conveying screw 50, the radial length of the conveying screw 50 is changed depending on a phase of rotation of the conveying screw 50. Specifically, the radial length of the conveying screw 50 is gradually changed, as the conveying screw 50 is rotated from a state that the circumferential surface of the screw shaft 51 is located at a position farthest from the center of the axis of the screw shaft 51 to a state that an apex portion of the blade portion 52 is located at the farthest position. This facilitates the swinging ball 60 to swing up and down, as the conveying screw 50 is rotated, and makes it possible to use the swinging ball 60 as a driving source for swinging the toner loosening member 40 up and down.

Further, in the embodiment, the swinging member is the swinging ball 60 (spherical member) which is contacted with the conveying screw 50 by the weight of the swinging ball 60. In the embodiment, the swinging ball 60 swings up and down while rolling as the conveying screw 50 is rotated. Thus, no or less load is exerted on the conveying screw 50 when the conveying screw 50 is rotated and driven.

Furthermore, the toner conveying portion 30 is composed of a substantially L-shaped tubular member constructed by integrally connecting the vertical conveying portion 31 and the horizontal conveying portion 32. The upper end of the vertical conveying portion 31 is communicated with the toner discharge port 15H, and the toner ejection port 322 communicating with the toner replenishment port 23H is formed in the downstream end of the horizontal conveying portion 32. With this arrangement, a portion from the toner discharge port 15H to a start portion of the horizontal conveying portion 32 is constituted merely by the vertical conveying portion 31. Thus, it is possible to prevent coagulation of toner in the vertical conveying portion 31 by the swinging movement of the toner loosening member 40. Further, coagulation of toner is constantly prevented by rotation of the conveying screw 50 in the horizontal conveying portion 32. Accordingly, there is no or less likelihood that toner may be coagulated in the entirety of the toner conveying portion 30.

An embodiment of the present disclosure has been described in detail as above. The present disclosure is not limited to the above. The following modifications may be applied to the present disclosure.

(1) In the embodiment, the blade portion 52 formed on the conveying screw 50 is described as an example of a projecting portion for causing the swinging ball 60 to swing. Alternatively, a projecting portion may be formed on the screw shaft 51 in addition to the blade portion 52. Examples of the projecting portion may be a rib formed in the radial direction of the screw shaft 51, or a cam member.

(2) In the embodiment, the toner loosening member 40 having a coil spring shape is described as an example of the toner loosening member. This is merely an example. For instance, it is possible to use a toner loosening member configured in such a manner that a projection or a rib is radially formed on a vertically extending base member.

(3) In the embodiment, the swinging ball 60 (spherical member) is described as an example of the swinging member. The swinging member may not necessarily be a spherical member. For instance, the swinging member may be a member configured in such a manner that an upper part thereof in contact with the toner loosening member 40 has a prismatic shape and a lower part thereof in contact with the conveying screw 50 has a hemispherical shape.

(4) In the embodiment, the toner containers 15M, 15C, 15Y, 15Bk serve as a first container, and the developing devices 23 serve as a second container. The types of the first and second containers are not limited to the above, and any containers having such a relation that toner is supplied and received may be used.

According to the present disclosure, it is possible to securely convey toner in a toner conveying portion configured in such a manner that a horizontal conveying portion is disposed at a position posterior to a vertical conveying portion, without coagulation of the toner. Thus, the present disclosure is advantageous in conveying toner from the first container to the second container without stagnation, thereby contributing to maintaining high-quality image formation.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A toner replenishing device, comprising:

a first container which stores toner for replenishment, and has a discharge port of toner;

a second container which has a replenishment port of toner, and stores replenished toner;

a toner conveying portion which conveys the toner in a region between the discharge port and the replenishment port, the toner conveying portion including a vertical conveying portion for vertically conveying the toner, and a horizontal conveying portion for receiving the toner from the vertical conveying portion and horizontally conveying the received toner;

a conveying member which is disposed in the horizontal conveying portion, the conveying member including a shaft member extending in an extending direction of the horizontal conveying portion, and a projecting portion formed around the shaft member, the conveying member being adapted to convey the toner by being rotated about an axis of the shaft member;

a toner loosening member which is disposed in the vertical conveying portion to be swingable up and down; and a swinging member which is disposed at a connecting portion between the vertical conveying portion and the horizontal conveying portion to be contactable with the conveying member and the toner loosening member, wherein the swinging member swings up and down in accordance with a movement of the swinging member which is operable to change a contact portion of the swinging member with respect to the conveying member between the shaft member and the projecting portion, as the conveying member is rotated, the toner loosening member swings up and down, as the swinging member swings, the conveying member is a conveying screw having the shaft member, and a blade portion formed spirally around the shaft member, as the projecting portion the swinging member is a spherical member that is contacted with the conveying member by the weight of the swinging member, a lower part of the spherical member being contacted with the conveying screw, the toner loosening member is a member having a coil spring shape, the toner loosening member having a circular ring portion at a lower end thereof, the circular ring portion having an inner diameter smaller than a diameter of the spherical member, the circular ring portion is slidably received at an upper part of the spherical member by the weight of the toner loosening member, and a horizontal movement of the spherical member is restricted by a wall surface for dividing the vertical conveying portion.

2. The toner replenishing device according to claim 1, wherein a spiral pitch of the blade portion of the conveying screw is set larger than a diameter of the spherical member.

3. The toner replenishing device according to claim 1, wherein an upper end of the vertical conveying portion is communicated with the discharge port.

4. The toner replenishing device according to claim 1, wherein the toner conveying portion is composed of a substantially L-shaped tubular member constructed by integrally connecting a vertical tubular portion constituting the vertical conveying portion and a horizontal tubular portion constituting the horizontal conveying portion, and an upper end of the vertical tubular portion is communicated with the discharge port, and a downstream end of the horizontal tubular portion is formed with an ejection port communicating with the replenishment port.

5. The toner replenishing device according to claim 1, wherein the first container is a toner container which stores toner for replenishment, and the second container is a developing device which supplies toner to an image carrier.

6. An image forming apparatus, comprising:

an image carrier which carries an electrostatic latent image;

a toner container which stores toner for replenishment, and has a discharge port of toner;

a developing device which has a replenishment port of toner, and supplies toner to the image carrier;

a toner conveying portion which conveys the toner in a region between the discharge port and the replenishment port, a toner conveying portion including a vertical conveying portion for vertically conveying the toner, and a horizontal conveying portion for receiving the toner from the vertical conveying portion and horizontally conveying the received toner;

a conveying member which is disposed in the horizontal conveying portion, the conveying member including a shaft member extending in an extending direction of the horizontal conveying portion, and a projecting portion formed around the shaft member, the conveying member being adapted to convey the toner by being rotated about an axis of the shaft member;

a toner loosening member which is disposed in the vertical conveying portion to be swingable up and down; and a swinging member which is disposed at a connecting portion between the vertical conveying portion and the horizontal conveying portion to be contactable with the conveying member and the toner loosening member, wherein the swinging member swings up and down in accordance with a movement of the swinging member which is operable to change a contact portion of the swinging member with respect to the conveying member between the shaft member and the projecting portion, as the conveying member is rotated, the toner loosening member swings up and down, as the swinging member swings the conveying member is a conveying screw having the shaft member, and a blade portion formed spirally around the shaft member, as the projecting portion, the swinging member is a spherical member that is contacted with the conveying member by the weight of the swinging member, a lower part of the spherical member being contacted with the conveying screw, the toner loosening member is a member having a coil spring shape, the toner loosening member having a circular ring portion at a lower end thereof, the circular ring portion having an inner diameter smaller than a diameter of the spherical member, the circular ring portion is slidably received at an upper part of the spherical member by the weight of the toner loosening member, and a horizontal movement of the spherical member is restricted by a wall surface for dividing the vertical conveying portion.

7. The image forming apparatus according to claim 6, wherein a spiral pitch of the blade portion of the conveying screw is set larger than a diameter of the spherical member.

8. The image forming apparatus according to claim 6, wherein an upper end of the vertical conveying portion is communicated with the discharge port.

9. The image forming apparatus according to claim 6, wherein the toner conveying portion is composed of a substantially L-shaped tubular member constructed by integrally connecting a vertical tubular portion constituting the vertical conveying portion and a horizontal tubular portion constituting the horizontal conveying portion, and an upper end of the vertical tubular portion is communicated with the discharge port, and a downstream end of the horizontal tubular portion is formed with an ejection port communicating with the replenishment port.

* * * * *